US005107689A

United States Patent [19]

Plath et al.

[11] Patent Number: 5,107,689

[45] Date of Patent: Apr. 28, 1992

[54] DEVICE FOR SWITCHING ON AND OFF AT LEAST ONE FUNCTIONAL UNIT OF A KNITTING MACHINE

[75] Inventors: Ernst-Dieter Plath, Albstadt; Gerhard Grözinger, Spaichingen, both of Fed. Rep. of Germany

[73] Assignee: SIPRA Patententwicklungs-u.Beteiligungs-gesellschaft mbH, Albstadt, Fed. Rep. of Germany

[21] Appl. No.: 498,983

[22] Filed: Mar. 26, 1990

[30] Foreign Application Priority Data

Mar. 24, 1989 [DE] Fed. Rep. of Germany ..... 3909817

[51] Int. Cl.[5] ..... D04B 35/00

[52] U.S. Cl. ..... 66/218; 66/232

[58] Field of Search ..... 66/218, 232, 161, 163, 66/13, 25, 138, 218, 219, 220

[56] References Cited

U.S. PATENT DOCUMENTS

| | | | |
|---|---|---|---|
| 3,821,526 | 6/1974 | Anderson | 66/25 X |
| 3,940,954 | 3/1976 | Romoli | 66/163 X |
| 3,945,224 | 3/1976 | Billi | 66/232 X |
| 4,036,034 | 7/1977 | Aisaka et al. | 66/218 X |
| 4,408,118 | 10/1983 | Grözinger | 66/218 X |
| 4,607,507 | 8/1986 | Jacobsson | 66/163 X |
| 4,628,710 | 12/1986 | Jacobsson | 66/163 X |
| 4,713,655 | 12/1987 | Sommer et al. | 66/163 X |
| 4,763,492 | 8/1988 | Tibbals, Jr. | 66/232 |
| 4,841,748 | 6/1989 | Watanabe et al. | 66/163 X |

*Primary Examiner*—Werner H. Schroeder
*Assistant Examiner*—John J. Calvert
*Attorney, Agent, or Firm*—Michael J. Striker

[57] ABSTRACT

The switching device is designed for switching on or off an electrical switching element assigned control to at least one functional unit of a knitting machine, including a timing generator and a pattern controlling device delivering binary control signals used for the selection or the non-selection of knitting needles according to a desired pattern. The switching device includes an electrical switching circuit having a first input connected to a pattern controlling device and an output connected to the electrical switching member, and further includes a device which, at the output, produces a switching, on or off signal when the input receives a predetermined sequence of the binary control signals of the same binary value, or when, after the predetermined sequence, there occurs a control signal of the other binary value or when this other conrol signal of the other binary value occurs after a predetermined time delay.

16 Claims, 4 Drawing Sheets

DEVICE FOR SWITCHING ON AND OFF AT LEAST ONE FUNCTIONAL UNIT OF A KNITTING MACHINE

BACKGROUND OF THE INVENTION

The present invention relates to a device for switching on and off an electrical switch assigned to control at least one functional unit of a knitting machine to select between two different operational conditions of the unit. The knitting machine includes a plurality of selectable needles, a generator for delivering timing signals for the knitting machine, a pattern controlling device for delivering binary control signals to selectively activate or inactivate the needles according to a predetermined pattern.

In circular or flat knitting machines, the switching devices of this kind activate or deactivate the knitting needles during a loop or mesh forming process, take up a thread and the like, and switch on and off the functional units, for example, the thread inserting members of a thread changing apparatus or a locking part. As a rule, the controlling signals are stored in a memory of the pattern controlling device, read out from the memory in synchronism with the cycles of the knitting machine and supplied to a selecting device for the needles or to a switching member for the functional unit and the like. Each pattern control signal causes immediately a predetermined action of the needle selecting device or of the switching member. All control signals form together a program assigned for a selected knitting pattern.

For other applications special devices are necessary which do not operate according to the predetermined program but always automatically switch on or off certain functional units when a predetermined sequence of the control signals occurs in the course of controlling an arbitrary pattern.

For example, in the production of patterns a reliable monitoring of a thread immediately at the point of knitting becomes difficult when the thread is being worked at some times and not being worked at other times and, in the latter case, is held by a pneumatically operating suction nozzle or a mechanical clamping device (DE-AS No. 11 48 347 and DE-AS No. 12 20 076). In the first mentioned case, a mechanical stopping device (DE-OS No. 25 56 387) for monitoring the presence of a thread causes the stoppage of the knitting machine only in the case when the thread is supplied in due order because its spring biased arm withdraws the thread from suction nozzle. By contrast, a stopping device reacting to the movement of the thread (DE-PS No. 15 60 582, DE-PS No. 29 07 653, French Patent No. 14 00 308, Swiss Patent No. 479 478 and Swiss Patent No. 596 078) stops the knitting machine independently of the condition of thread. Both in the case, when for the pattern forming purposes, the thread is temporarily held motionless by a mechanical or pneumatic clamping or holding device, and also in the case of malfunction, for example when the thread due to breakage is no longer moving, this stopping device stops the machine. The solution of such problems by prior art devices is not possible.

A different problem occurs at certain knitting machines for the production of plush knitwear (DE-OS No. 31 45 307). In such machines the temporarily unprocessed plush threads float behind those needles which process the plush thread. If the floating thread portions reach a certain length depending on the type of the knitting machine, then there is the danger that the plush loops present at the beginning of the floating portions are shortened when the formation of the plush loops is resumed at the beginning of the floating portion. To avoid this problem it has been proposed to equip the knitting machine with the so-called thread wheels which clamp the floating thread portions between its spurs and the plush loops, thus preventing the subsequent shortening of the previously formed plush loops. For operational reasons it is desirable to inactivate the thread wheels by switching members such as electromagnets and the like, when the floating thread parts reach a certain minimum length, so as to be able to cut the threads in a conventional manner in order to avoid excessively long floating parts and to clamp the thread by a pneumatic or mechanical means (DE-OS No. 38 12 124). Device for solving this problem are not yet known.

SUMMARY OF THE INVENTION

It is therefore an object of the present invention to provide a switching device of the above described kind by which a functional unit of a knitting machine is switched from one operational state or condition to another depending on control signals delivered by a pattern controlling device, whereby for carrying out the switchover no special data, additionally stored in the pattern controlling device are necessary but only the existing control signals are employed for this purpose.

In keeping with this object and others which will become apparent hereafter, one feature of this invention resides in the provision of an electrical switching circuit having a first input for receiving the binary control signals from the pattern controlling device, and an output for controlling an electrical switch, the electrical control circuit further including means for delivering at the output a switching on/off signal when a predetermined first or second sequence of the binary control signals is applied to the first input, means for holding for a predetermined period of time the switching on/off signal at the output, and means for reversing the switching on or off signal at the output when the predetermined period of time has expired.

The device of this invention has the advantage that it performs a kind of self-control by evaluating the sequences of the binary control signals and automatically switching the operational state of the functional unit in response to a predetermined sequence of the binary control signals. In this manner, the switching device is fully independent of the particular sequences for determining the selection or the non-selection of the needles on the one hand and without any additional programming device can control the functional units of the knitting machine. In addition, the device of the invention has the advantage that it does not require any complicated modifications in the control of the knitting machine. It can be included in the pattern controlling device additionally and without any adjustment of the latter.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
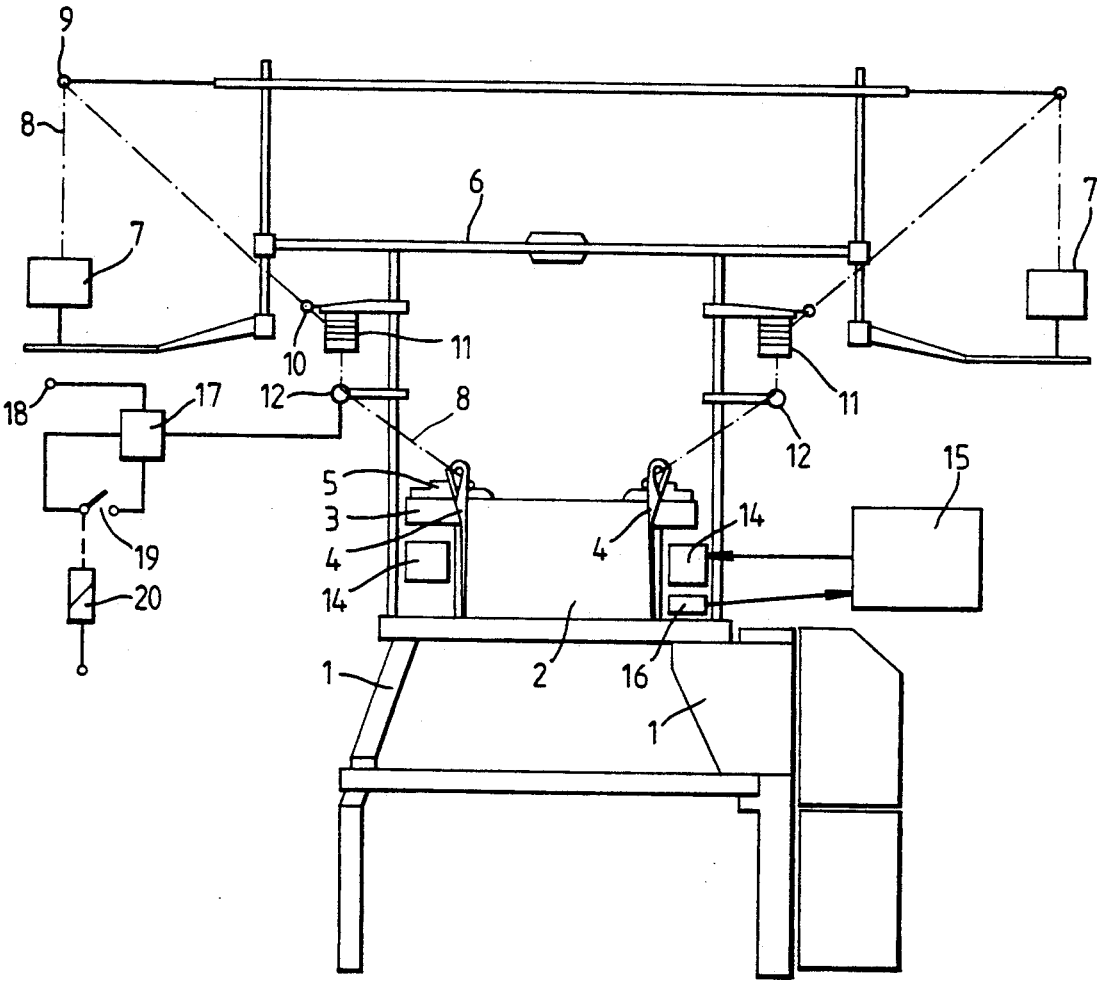
FIG. 1 is a schematic elevational view of a circular knitting machine.

The circular knitting machine of FIG. 1 includes a frame 1, in which a needle cylinder 2 and a sinker ring 3 are rotatably supported. Knitting needles 4 are shiftably supported in the needle cylinder 2 whereas notched bars or jacks 5 are shiftably supported in the sinker ring 3. Supply spools 7 for thread 8 are arranged on carrier 6 fixed on the frame 1 above the needle cylinder 2. The threads 8 are fed through eyelets 9 and 10 to the needles 4 and the jacks 5. Each thread 8 passes through an assigned delivery device 11, for example a so-called storing supplier and through a functional unit in the form of a stopping device 12 arranged between the storing supplier and the needle cylinder 2. In a plurality of systems distributed on the periphery of the needle cylinder 2 there are provided needle selecting devices 14 including selecting members in the form of solenoids and the like to which binary control signals are delivered from an electrical pattern controlling device 15 in order to control the selection or non-selection of the needles 4 according to a knitting pattern or for controlling reception or the non-reception of the threads 8 and the like. The binary control signals are delivered by the pattern controlling device 15 in synchronism with the cycles of the circular knitting machine; for this purpose, the machine includes a timing generator 16 which senses for example the the guiding webs of the needle cylinder 2 between which the needles 4 are shiftably supported so that with each passing of a web a timing signal is generated and applied to the pattern controlling device 15.

Circular knitting machines of this kind and their functions are generally known (DE-OS No. 19 61 013) and need not be explained in detail for the purpose of this invention.

The illustrated stopping device 12 is preferably in the form of the above-described stopping device which reacts to the motion of the thread 8. As a consequence, an evaluation circuit 17 connected to the stopping device 12 always delivers at its output 18 a switch off signal for the knitting machine when the thread 8 comes to a stillstand, for example due to a breakage, a jamming in the thread guiding eyelet 10 and the like. To prevent the stopping device 12 from turning Off the knitting machine in the case when the movement of the thread 8 is intentionally stopped in the course of the formation of a particular knitting pattern, for example by means of a non-illustrated cutting and clamping device, the power supply for the stopping device is provided with a schematically illustrated switching contact 19 controlled by an electromagnetic control member, for example in the form of a relay 20. If the contact 19 is switched on, the stopping device 12 operates in conventional manner. However, if the contact 19 is switched off then the power supply to the stopping device 12 is interrupted, the stopping device becomes inoperative and no switch off signal for the knitting machine is delivered at the output 18, even if the thread 8 is brought to standstill. In doing so, in principle it makes no difference whether the knitting machine is a circular knitting machine for producing flatwears, or knitwear having circular patterns or for producing plush fabric and the like or whether the monitored thread 8 is a base thread, a circular thread or a plush thread and the like.

Figure 2:
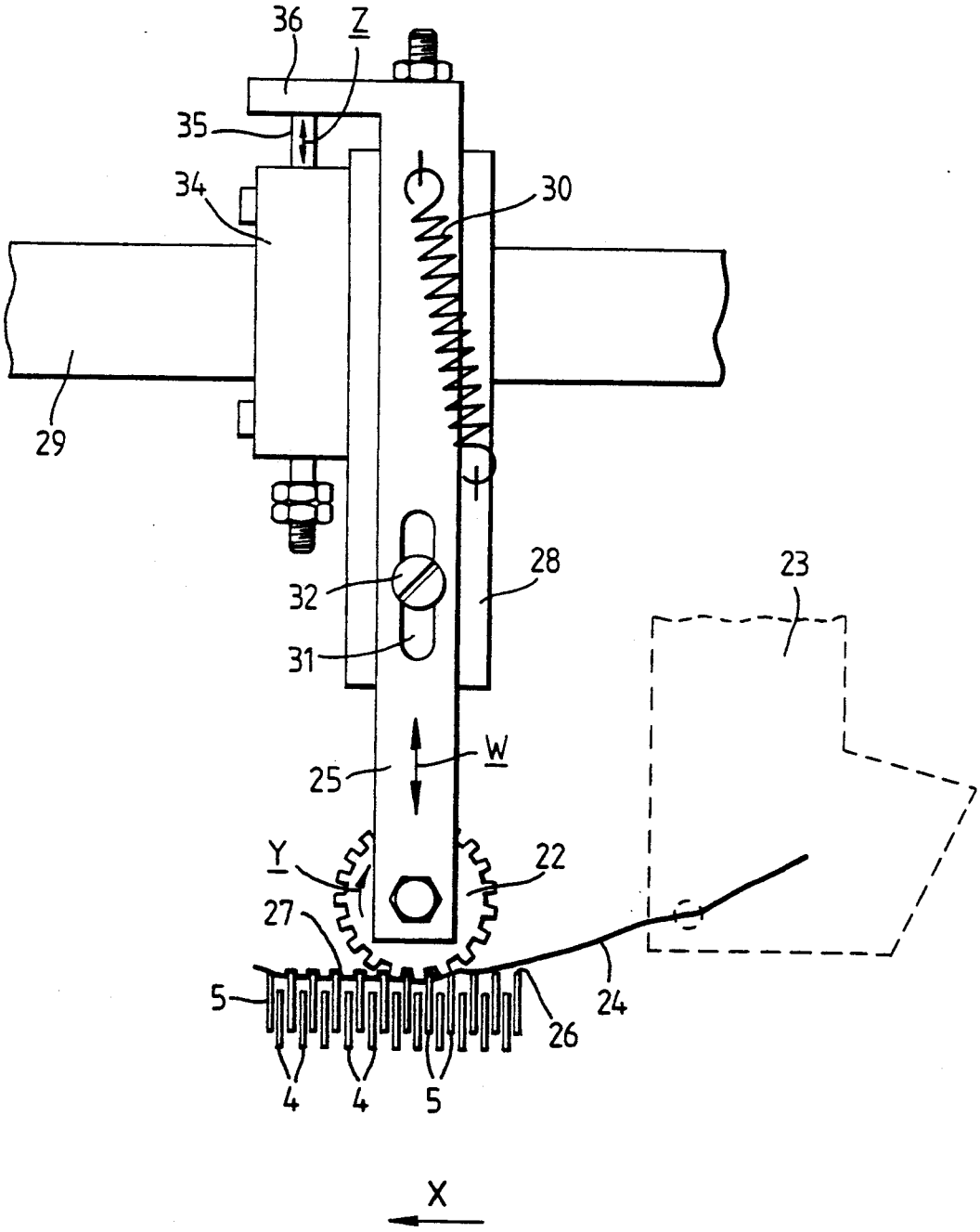
FIG. 2 is an elevational view of a switchable thread clamping wheel for the knitting machine of FIG. 1, shown on an enlarged scale.

In the embodiment of FIG. 2 it is assumed that the circular knitting machine is designed for the production of plush knitwear and the jacks 5 include plush jacks. In the circular machines of this kind (particularly according to the DE-OS No. 31 45 307) it is sometimes desirable to provide in each system at least an additional functional unit in the form of a switchable thread clamping wheel 22 arranged between a plush thread guide 23 and a portion of a system in which a plush thread 24 together with a non-illustrated base thread is processed into a loop or mesh. The thread wheel 2 is supported for rotation on a carrier 25. In the operating position illustrated in FIG. 2, the circumferential surface of the thread wheel 22 is in operative connection with the upper edge 26 of at least one plush jack 5. For the sake of simplicity, FIG. 2 shows only several plush jacks 5 with knitting needles 4 arranged therebetween.

The thread wheel 22 has the effect that plush thread 24 fed from the guide 23 is laid as a floating thread 27 on the upper edges 26 of the jacks 5 as long as the corresponding needles 2 on the plush thread guide 23 are not selected for receiving the plush thread 24. This floating thread 27 is then clamped between the upper edge 26 of at least one jack 5 and the thread wheel 22 when the latter is in its working position. In this way it is guaranteed that the amount of threads which are needed for the formation of a subsequent plush loop or mesh, are not taken from the floating thread 27 itself or from a previously formed plush thread mesh present in a mesh forming system but are taken only from a supply spool 7 assigned to plush thread guide 23.

The support or carrier 25 of the thread wheel 22 is preferably shiftable in a holder 28 to move in two opposite directions indicated by arrow w. The holder 28 is secured to a stationary part 29 of the knitting machine and is biased by a spring 30 attached between the holder 28 and the carrier 25 to move in the direction toward the jacks 5. The biasing spring 30 adjusts the pressure and hence the clamping force of the thread wheel 22. The sliding support is adjusted for example by slot 31 formed in the carrier 25 and by a guiding bolt 32 passing through the slot 31 and secured to the holder 28. The moving direction of the carrier 25 is preferably normal to the upper edges 26 of the jacks 5 whereas the axis of rotation of the thread wheel 22 is preferably parallel to the upper edges 26 and to the center planes of the jacks 5.

Since the thread wheel 22 is needed only for those patterns at which the loose floating thread portions 27 may have a critical length, it is further provided that the operative connection between the thread wheel 22 and the jacks 5 can be selectively released or resumed. For this purpose there is provided a switching member in the form of a controllable solenoid 34 having a movable armature 35 by which upon the energization or de-energization of the solenoid the carrier 25 is brought into or out of its working position. The solenoid 34 is screwed to the holder 28 in such a manner that the directional movement of the armature 35 indicated by arrow z in FIG. 2 is parallel to the direction of movement of the carrier 25. When the solenoid is energized, an arm 36 of the carrier 25 is brought by the action of the biasing spring 30 into contact with the end of armature 35. When the solenoid is de-energized the carrier 25 is lifted by the armature 35 against the force of the biasing spring 30 and thus lifts the thread wheel 22 away from the jacks 5.

The length of the loose floating portion of the plush thread 24 depends on how many successive needles 4 had been preselected for the non-reception of the plush thread, that means how many consecutive binary control signals corresponding to the command "no selection" are delivered from the pattern controlling device 15 to the corresponding selecting device 14. These "no selection" control signals in the following are designated as "0" signals whereas the "selection" signals are designated as "1" signals. If desired, the level of these signals could be reversed. It is only of importance that the control signals have two distinguishable values. If the critical length of the floating thread portion 27, expressed in the number of consecutive needles 4 which have not received the plush thread 24 (non-receiving needles), then it does not matter when the length of the floating thread 27 has the critical length or a shorter one as long as no more than twenty to twenty-two consecutive "0" signals ar supplied to the selecting device 14. If the pattern controlling device 15 delivers more than the above mentioned twenty-two consecutive "0" signals, the floating portion 27 of the thread is longer than the critical length and therefore that the thread clamping wheel 22 can be shifted out of its working position in the case when the length of the floating portion 27 becomes still larger.

Figure 3:
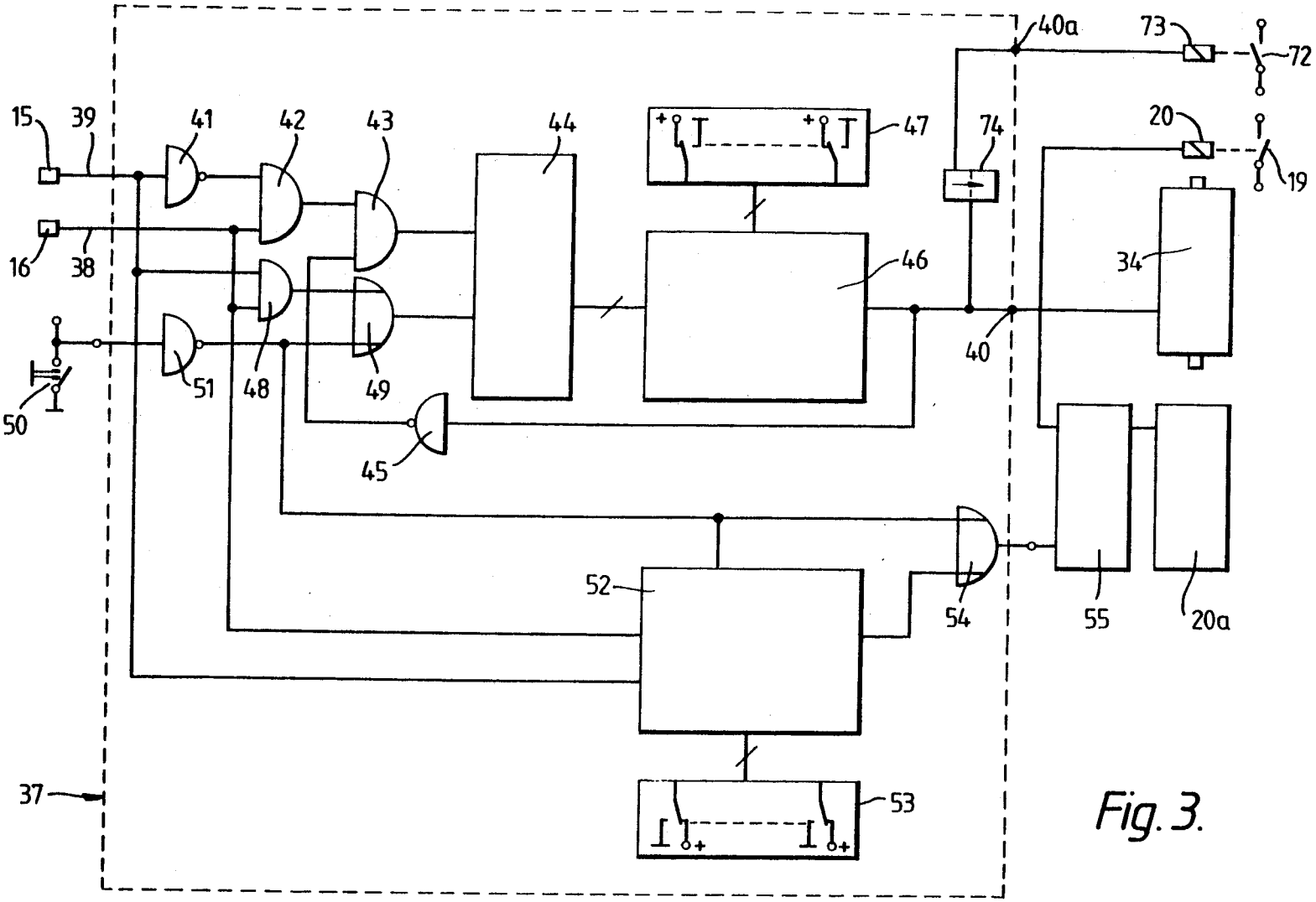
FIG. 3 is a circuit diagram of an electronic switching circuit according to this invention for switching on or off at least one functional unit of the knitting machine of FIG. 1 or the unit of FIG. 2.

According to this invention device illustrated in FIG. 3, after a predetermined number of "no selection" signals for example after a first predetermined succession of thirty consecutive "0" signals, generates a first switching signal for the solenoid 34 which in turn displaces the thread wheel 22 out of its working position. Further the device is designed such that this condition remains unchanged as long as the thirty "0" signals are followed by further binary control signals of the same value; and that in response to the first occurrence of a control signal of an opposite value after the above mentioned sequence of "0" signals, a second switching signal for the solenoid 34 is generated which returns the thread wheel 22 into its operative connection with the jacks 5. The latter condition remains until again a sequence of "0" signals is generated. In this manner the thread wheel 22 is automatically controlled such that it remains in engagement with jacks 5 until the length of the floating portion 27 of the thread is less than a predetermined number of facing needles 4. In the case of a longer floating portion 27 the wheel 22 is automatically disengaged.

The lifting of the thread wheel 22 from the jacks 5 has the consequence that from this time point the resulting portions of the floating thread no longer run along the circle of needles as the jacks 5 do. The floating thread portions 27 align themselves along a cord of the needle circle and can be cut off by means of conventional mechanisms (known for example from DE-AS No. 11 48 347) including the thread holding and cutting elements. In this manner the loss of thread can be reduced in spite of the occurrence of very long loose floating thread portions. Another mechanism of this kind has been described in applicants' prior application (Ser. No. 07/335,818 of Apr. 10, 1989) the entire disclosure of which is incorporated herein by reference.

The clamping of the cut off parts of the thread would have the consequence that the stopping device 12 would turn off the knitting machine. The switch device of this invention (FIG. 3) therefore is connected to the switching member (for example a relay 20) of the stopping device 12 in such a manner that the stopping device is switched off by the first switching signal or by another switching signal which is time delayed with respect to the first one. The time delay is obtained such that the stopping device is turned off only after the thread, upon the disengagement of the thread wheel 22, has been cut off by a cutting device and clamped by a clamping device and thus actually brought to a standstill. Accordingly, the switching device of this invention is connected to the switching member of the stopping device 12 in such a way that the latter is switched on by the second switching signal or by a signal which is time delayed with respect to the second switching signal. By the time delayed second switching signal the condition is taken into account that the thread at the occurrence of the second switching signal is usually not yet set in motion. Moreover a certain number of machine cycles has passed until after the occurrence of the second switching signal. The needle assigned to the first signal value "1" actually takes up the thread and moves the same so that the stopping device 12 only at a later time point can be switched on again. The respective delays are preferably defined by the number of needles or machine cycles which from the occurrence of the first or second switching signals up to the turning on of the stopping device 12 or of another functional unit have elapsed.

The switching device of this invention, as shown in FIG. 3, includes an electrical switching circuit 37 having a third input 38 connectable to the timing generator 16, a first input 39 connectable to the pattern controlling device 15 and an output 40 connectable to a switching member of a functional unit of the knitting machine for example to a relay 20. The electrical switching circuit 37 is designed such as to produce at the output 40 a first switching signal which brings contact 19 of relay 20 into an open condition in which the stopping device 12 is set into its deenergized state when the input 29 receives a first predetermined sequence of binary control signals consisting of a predetermined number of control signals of the same value, for example of "0" signals. On the other hand, the switching circuit 37 delivers at its output 40 a second switching signal which brings the contact 19 of the relay 20 into its closed condition in which the stopping device is brought into its operational state when the input 39 receives a second predetermined sequence of binary control signals. The second sequence consists either of a single signal of the opposite value (for example a "1" signal) provided the latter immediately follows the first sequence of signals or of an arbitrary number of further binary control signals following the first sequence of control signals of the one signal value and the first subsequent signal of the opposite signal value. Accordingly, the switching member (solenoid 34) of the other functional unit (thread wheel 22) is controlled by the output 40 such that the thread wheel 22 is lifted away from the jacks 5 in response to the first switching signal and returned into engagement with the jacks 5 in response to the second switching signal.

In the embodiment of FIG. 3 it is assumed that the pattern controlling device 15 delivers "1" signals corresponding to the command "selection for taking up the plush thread 24"; and "0" signals corresponding to the command "no selection, no take up of the plush thread 24". It is also assumed that the timing signals delivered by the timing generator 16 are "1" signals. In this case, the input 39 is connected to an inverter 41 whose output is connected with an input of an AND gate 42 whose output is connected through an input of another AND gate 43. The output of the AND gate 43 is connected to a counting input of an 8-bit binary counter 44. The other input of the AND gate 42 is connected to the input 38, and the second input of the AND gate 43 is connected via an inverter 45 to the output 40. The binary counter 44 has eight outputs connected to a comparator 46. The output of the comparator 46 is connected to the output 40 of the switching circuit 37. The comparator 46 has additional eight inputs connected with setting block 47 by which the comparator can be adjusted to an arbitrary count condition of the counter 44 (for example up to 256 possible counts).

The input 39 is further connected with an input of a further AND gate 48 whose output is connected to an input of an OR gate 49. The output of the OR gate 49 is connected to the resetting input of the binary counter 44. The second input of the AND gate 48 is connected to the input 38 of the switching device.

The operation of the electric switching device 37 is as follows:

The "0" signals from an output of the pattern controlling device 15 are changed in the inverter 41 into "1" signals which, together with the timing signals from the generator 16 are applied to the inputs of the AND gate 42 to control the AND gate 43. The second input of the AND gate 43 is normally supplied with "1" signal inasmuch as the output 40 is normally at "0" state, that means it delivers the first switching signal at which the relay 20 and the solenoid 34 are deenergized. At this condition of the second input of the AND gate 43 the "1" signals delivered by the A are supplied to the counting input of the counter 44 which keeps counting until its count reaches a predetermined counting condition of the comparator 46. At this moment, the first sequence of binary control signals is completed and the comparator 46 changes its output from "0" to "1", that means the comparator 46 now delivers a second switching signal by means of which the relay 20 and the solenoid 34 are turned on and consequently the stopping device 12 and the thread wheel 22 are brought into their activated conditions. In addition, the "1" signal at the output of the comparator 46 is inverted in an inverter 45 to a logic "0" supplied to the second input of the AND gate 43 so that the latter acts as a blocking device which prevents feeding of further signals to counter 44. This condition is preserved even if the first sequence of "0" signals at the input 39 is followed by a second sequence of "0" signals.

If at the input 39 a "1" signal occurs before the counter 44 has reached the count preset in the comparator 46 then due to the action of the inverter 41 this signal "1" can not reach the counting input of the counter 44. Instead, this "1" signal is supplied via the AND gate 48 and the OR gate 49 to the resetting input of the counter 34 and resets the same to "0". Therefore, the original "0" condition (logic "0") at the output 40 is preserved until the sequence of "0" signals at the input 39 has not reached the preset count.

If after a signal sequence which contains more consecutive "0" signals than is the preset count for the counter 44, and a "1" signal of the second signal sequence has for the first time occurred at the output 39, then the latter signal causes via the AND gate 48 and the OR gate 49 also a resetting of the counter 44. Consequently, a count of the counter 44 does not match the count preset by the comparator 36 and therefore the first switching signal (logic "0") occurs at the output 40 and the setting device 12 together with the thread wheel 22 are brought into activated condition again. The counter 44, the comparator 46 and the block 47 form together an evaluation or recognition device for the preselected signal sequences.

By a key operated switch 50 a "0" signal is generated and applied via an inverter 51 to the second input of the OR gate 49 so that the counter 44 can be manually reset at any desired time point.

If it is desired to switch over different functional units or their switching members at different time points, the electrical switching circuit of FIG. 3 can be additionally equipped with a 64-bit shift register 52. The shift register has inputs connected to a setting block 53 by which the delay times of the shift register 52 are adjustable to a preselected number of timing pulses. In general, the data input of the shift register 52 is connected to the input 39, the timing input to the input 38 and its output is connected to an input of an OR gate 54 whose output serves for resetting a flipflop 55 designed for example as a RS-flopflop. The other input of OR gate 54 is connected to the resetting input of the shift register 52 and to the output of the inverter 51.

With the provision of the shift register 52 and the flipflop 55, the above described condition of the switching device with respect to the switching off of a relay **20*a* is not changed inasmuch a "1" signal at the input 40 sets the flipflop 55 and therefore causes energization of the relay 20*a*. On the other hand, if after a sufficiently long sequence of "0" signals at the input 39 a "1" signal appears for the first time at this input then the "1" signal is time delayed by the shift register 52 by as many timing pulses as to correspond to the delay time preset by the block 53; consequently, the flipflop 55 is reset with a corresponding time delay and the stopping device 12 assigned to the relay 20*a* is accordingly activated with a time delay. For the sake of simplicity in this example it is assumed that the count preset in the block 47 is at least equal to the number of time delaying cycles set in the block 53. Otherwise, additional measures would be necessary to insure that the flipflop 55** is not unintentionally reset prematurely.

Figure 4:
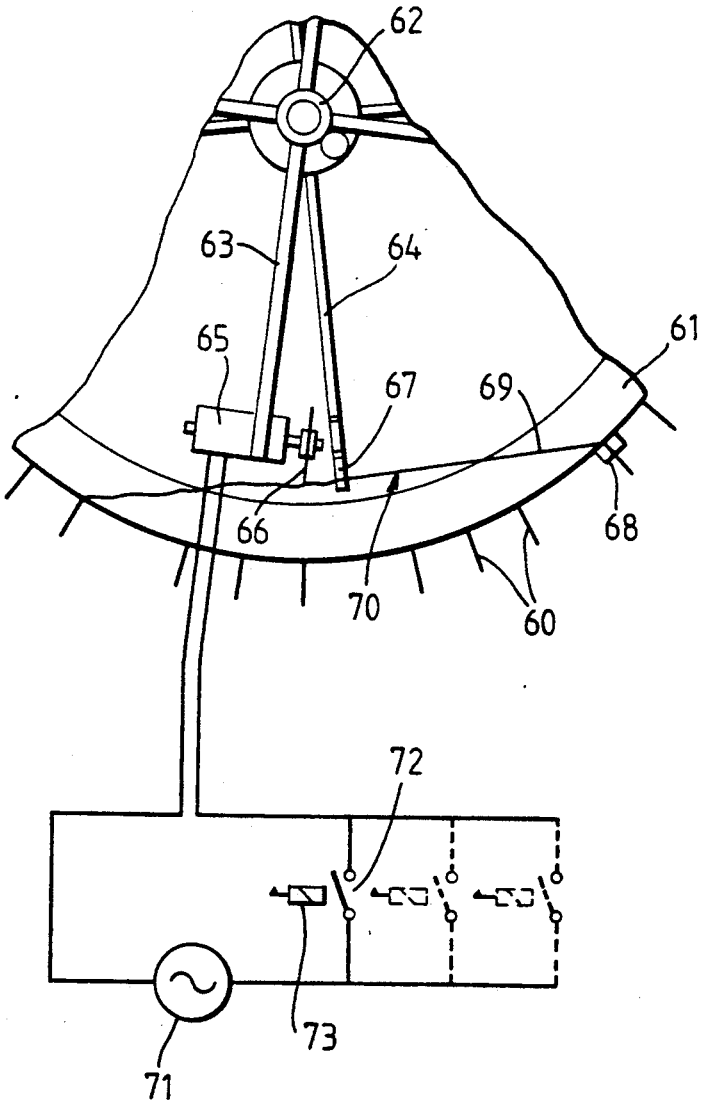
FIG. 4 is a detailed schematic elevational view of a portion of a cutting disc for the knitting machine of FIG. 1 inclusive of a switchable electric motor.

Referring to FIG. 4 there is schematically illustrated a portion of a circular knitting machine having a functional unit in the form of a cutting device. The machine includes a needle cylinder 61 with knitting needles 60. In the interior of the needle cylinder 61 a central holding support 62 provided with radial holding rods 63, 64 is arranged. The holding rods 63 carry a cutting device, for example an electric motor 65 having a cutting disc 66 secured to its drive shaft whereas the holding rod 64 supports suction nozzles 67 or the like. In addition, FIG. 4 illustrates also a thread guide 68 for feeding in a thread 69. If a floating thread portion of the thread 69 is generated by the non-selection of a series of knitting needles 60 of an assigned knitting system and if the floating thread part reaches a predetermined length extending into the range of the cutting disc 66, then the latter is cut off. Simultaneously, an end of the floating thread part 70 is sucked by the suction nozzle 67 and held in a fixed position until the knitting needles 60 have been selected for picking up the thread. Circular knitting machines of this kind are known for example from DE-OS No. 38 12 124 and need not be described in detail.

According to the invention, the electric motor 65 is connected in a circuit including a voltage source 71 and a switching contact 72 of a relay 73. Similarly, as the contact 19, the contact 72 is closed when the relay 73 is energized and turns on the electric motor 65.

The electric switching circuit 37 of FIG. 3 has an additional output 40*a* connected with the first mentioned output 40 via a timing stage 74 and a relay 73. The timing stage 74 is designed for example as a monostable multivibrator and serves for keeping the electric motor 65 in its switched on condition for a predetermined period of time. The operation of this exemplary embodiment is as follows:

As long as no long loose floating parts 70 of the thread occur, at the output 40*a* is the second switching signal so that the relay 73 is deenergized and the electric motor 65 is switched off. If after the first predetermined sequence of for example thirty "0" signals, the first switching signal occurs at the output 40 then the first switching signal is supplied via the timing stage 74 also to the second output 40*a*. As a consequence, the relay 73 becomes energized and the electric motor 65 is switched on for a fixed time period determined by the timing stage 74. After the expiration of the predetermined time period the output 40*a* returns to its original switching condition corresponding to the second switching signal irrespective of the state at the output 40. Consequently, the electric motor 65 is turned off until the next sufficiently long floating thread portion is created.

If in the embodiment according to FIG. 4 a plurality of knitting systems is assigned to each knitting device then in the power supply circuit of the electric motor 65 can be provided a corresponding number of parallel connected contacts 72 of a corresponding number of relays 73. Each relay 73 is controlled by a separate switching device 37 which is controlled by those binary control signals which are applied to the corresponding system for the needle selection.

The switching times of the timing stages 74 are preferably adjustable to enable their selection in such a manner that a loosely floating thread portions of a predetermined length may be reliably cut off.

Alternatively, it is possible to replace the timing stage 74 by a flipflop which upon the occurrence of the first switching signal is set and after a predetermined number of machine cycles is reset. In this embodiment the predetermined time period during which a functional unit is switched on or off, does not depend on the occurrence of the second sequence of controlling signals.

Other types of cutting devices, using for example heated wires, can be also employed in connection with the device of this invention.

Circular knitting machines of the last mentioned kind are suitable particularly for the production of knitted fabrics in which certain patterns, for example lettering, are supposed to occur only at larger spacings from one another as is the case in the production knitted parts for pullovers and the like. Since the cutting device in this case is utilized only infrequently, this invention avoids excessive wear or power consumption.

The present invention is not intended to be limited to the details shown since many modifications and structural changes can be made without departing from the spirit of the present invention.

For example the switching device according to FIG. 3 can be employed for turning on/off also other functional units besides the thread clamping wheels or stopping devices and can be also employed with other types of knitting machines. Furthermore the particular logic circuits can be substituted with different interconnections of different types of logic gates, such as for example NAND/NOR technology instead of AND/OR technology. Furthermore, it is conceivable for each functional unit to provide a separate switching device of this invention and preset the same for different counts and/or delay times. Furthermore, it is also possible to select differently not only the switching on time points but also the switching off time points and employ thereto different structural parts as the above described counter and/or shift register. Of course, all functional units can be turned off with different time delays. Furthermore, the invention is not limited to the knitting machines for producing patterns in which loose floating parts of the thread having critical length because with patterns having non-critical length of the floating parts the above described effect is automatically achieved.

The invention permits also the above described switch over of the contact 19 even in the case when the solenoid 34 and the thread wheel 22 are absent. The counter 44 and the shift register 52 in this case are to be adjusted such that the stopping device 12 is always switched on when the thread is moving or brought out of action according to a desired pattern as long as the thread is intentionally brought into a standstill. Also it is possible to select other sequences of the binary controlling signal at which the assigned functional unit is switched over from one switching condition to the other one. The signal sequences are again composed of control signals of one or the other binary value. The switching device is to be modified in such a way as to be compatible with the desired form of the signal frequencies.

What is claimed as new and desired to be protected by Letters Patent is set forth in the appended claims.

We claim:

1. A device for switching at least one functional unit of a knitting machine to one or another of two different conditions, the knitting machine including a plurality of selectable needles, selecting means for receiving binary control signals to selectively activate or inactivate the needles, and, a pattern controlling device for sequentially delivering said binary control signals according to a predetermined pattern, the switching device comprising a switching element coupled to said functional unit for receiving a first switching signal for switching said functional unit into said one condition or a second switching signal for switching said functional unit into said other condition, and an electrical switching circuit having a first input coupled to an output of said pattern controlling device, which output is associated to said selecting means, and for also receiving said binary control signals, an output coupled to said switching element for delivering said first and said second switching signals, means for recognizing a predetermined sequence of said binary control signals and for delivering sequence of said binary control signal and for delivering at said output said first switching signal when said predetermined sequence is recognized, means for holding for a predetermined period of time the first switching signal, and for delivering said second switching signal said output when said predetermined period of time has expired.

2. A device as defined in claim 1, further comprising means for adjusting the predetermined period of time.

3. A device as defined in claim 1, further comprising means for setting the predetermined time period by a further preselected sequence of the binary control signals.

4. A device as defined in claim 3, wherein one of said switching signals is generated according to a sequence of a predetermined number of the control signals of one binary value and another of said switching signal is generated according to the occurrence of said first control signal of the other binary value following the first mentioned sequence.

5. A device as defined in claim 1, wherein the knitting machine further includes a generator for delivering timing signal and wherein said electrical switching circuit includes a second input for receiving timing signal.

6. A device as defined in claim 1, wherein the electrical switching circuit includes a binary counter having a counting input and a resetting input and said output for delivering the switching signals, the counting input receiving the binary control signals being coupled to said output.

7. A device as defined in claim 6, wherein the binary counter means has a binary counter and a comparator and wherein the binary counter is connected to the output of the switching device via said comparator, the comparator being adjustable to a preselected count value to deliver at the output of the switching device one of said switching signals, when a count of the counter is below the preselected count value, and to deliver at the output another of the switching signals, when another count of the counter reaches the preselected count value, and further comprising a blocking device connected to the counting input of the counter to block the binary controlling signals of the same binary value, when another count of the counter has reached the preselected count value until a control signal of another binary value is applied to the resetting input of the counter.

8. A device as defined in claim 9, further comprising means for setting the comparator to a predetermined count.

9. A device as defined in claim 1, wherein said electrical switching circuit further comprises a timing stage connected to the additional output and said switching element.

10. A device as defined in claim 1, wherein said switching device has a third input for receiving said timing signals.

11. A device as defined in claim 1 or 3, wherein one of said switching signals is generated according to a sequence of a predetermined number of the control signals of a binary value and another of said switching signals is generated after the occurrence of a first control signal of the other binary value following the first mentioned sequence even if said first signal is followed by additional controlling signals of the same binary value as that of the first mentioned sequence or of said other binary value as long as said predetermined sequence is not recognized.

12. A device for switching on or off a switching element assigned at least to one functional unit of a knitting machine to select between two different conditions of the unit, the knitting machine including a plurality of selectable needles, a generator for delivering timing signals for the machine, a pattern controlling device for delivering binary control signals to selectively activate or inactivate the needles according to a predetermined pattern, the switching device comprising an electrical switching circuit having a first input for receiving said binary control signals, and an output for controlling said switching element, said electrical switching circuit including means for delivering at said output a switching on or off signal when a predetermined first or second sequence of the binary control signals is applied to said first input, means for holding for a predetermined period of time the switching on or off signal at said output, and means for reversing the switching on or off signal at said output when said predetermined period of time has expired, the electrical switching circuit including a binary counter means having a setting and resetting input and an output for delivering the switching signals, the setting input receiving the control signals of one binary value and the resetting input receiving a control signal of the other binary value, the binary counter means having a binary counter and a comparator and wherein the binary counter is connected to the output of the switching device via said comparator, the comparator being adjustable to a preselected count value to deliver at the output of the switching device one of said switching on or off signals, when a count of the counter is below the preselected count value, and to deliver at the output another of the switching on or off signals, when the another count of the counter reaches the preselected count value, a blocking device connected to the setting input of the counter to block controlling signals of the same binary value, when another count of the counter has reached the preselected count value until a control signal of another binary value is applied to the resetting input of the counter; and means for delaying the switching of the functional unit with respect to the occurrence of the switching signals.

13. A device as defined in claim 12, further comprising a flipflop having a setting input and a resetting input, the setting input being connected to the output of the switching device and the resetting input being connected via a time delaying device with the first input of the electrical switching circuit.

14. A device as defined in claim 12, wherein the time delaying device is a shift register adjustable to a predetermined time delay.

15. A device for switching on or off a switching element assigned at least to one functional unit of a knitting machine to select between two different conditions of the unit, the knitting machine including a plurality of selectable needles, a generator for delivering timing signals for the machine, a pattern controlling device for delivering binary control signals to selectively activate or inactivate the needles according to a predetermined pattern, the switching device comprising an electrical switching circuit having a first input for receiving said binary control signals, and an output for controlling said switching element, said electrical switching circuit including means for delivering at said output a switching on or off signal when a predetermined first or second sequence of the binary control signals is applied to said first input, means for holding for a predetermined period of time the switching on or off signal at said output, and means for reversing the switching on or off signal at said output when said predetermined period of time has expired, said electrical switching circuit also comprising a timing stage connected to the additional output and said switching element, said timing stage being a monostable multivibrator.

16. A knitting machine comprising a plurality of selectable knitting needles; selecting means for receiving binary control signals to selectively activate or inactivate said needles according to a predetermined pattern; a pattern controlling device coupled to said selecting means for delivering said binary control signals; at least one functional component other than said selecting means and having two different conditions; a switching element coupled to said at least one functional component for receiving a first switching signal for switching said at least one functional component into one of said conditions or a second switching signal for switching said at least one functional component into another of said conditions; and an electrical switching circuit including a first input coupled to said pattern controlling means for receiving said binary control signals, an output coupled to said switching element for delivering said first and said second switching signal, means for recognizing a predetermined sequence of said binary control signals and for delivering to said output one of said switching signals when said sequence is recognized, and means for holding said one of said switching signals for a predetermined period of time and for delivering to said output another of said switching signals when said predetermined time has expired.

* * * * *

UNITED STATES PATENT AND TRADEMARK OFFICE

CERTIFICATE OF CORRECTION

PATENT NO. : 5 107 689

DATED : April 28,1992

INVENTOR(S) : Ernst Dieter Plath and Gerhard Grözinger

It is certified that error appears in the above-identified patent and that said Letters Patent is hereby corrected as shown below:

In column 11, line 6 after "signal" insert -at-

Signed and Sealed this

Thirty-first Day of August, 1993

Bruce Lehman

*Attest:*

BRUCE LEHMAN

*Attesting Officer*

*Commissioner of Patents and Trademarks*